US006274083B1

(12) United States Patent
Clark, III

(10) Patent No.: US 6,274,083 B1
(45) Date of Patent: Aug. 14, 2001

(54) METHOD OF PRODUCING A HOLLOW PISTON FOR A HYDROSTATIC POWER UNIT

(75) Inventor: Ernest Burdell Clark, III, Ames, IA (US)

(73) Assignee: Sauer-Danfoss Inc., Ames, IA (US)

( * ) Notice: Subject to any disclaimer, the term of this patent is extended or adjusted under 35 U.S.C. 154(b) by 0 days.

(21) Appl. No.: 09/593,992

(22) Filed: Jun. 14, 2000

(51) Int. Cl.[7] ..... B22F 5/10
(52) U.S. Cl. ..... 419/5; 419/40
(58) Field of Search ..... 419/5, 8, 40

(56) References Cited

U.S. PATENT DOCUMENTS

| | | | | |
|---|---|---|---|---|
| 3,319,575 | | 5/1967 | Havens | 103/162 |
| 3,882,762 | | 5/1975 | Hein | 92/181 |
| 3,996,048 | * | 12/1976 | Fiedler . | |
| 4,191,095 | | 3/1980 | Heyl | 92/78 |
| 4,216,704 | | 8/1980 | Heyl | 92/78 |
| 4,591,470 | * | 5/1986 | Goto et al. | 264/59 |
| 4,975,225 | * | 12/1990 | Vivaldi et al. | 264/28 |
| 5,076,148 | | 12/1991 | Adler | 92/158 |
| 5,216,943 | | 6/1993 | Adler et al. | 92/157 |
| 5,265,331 | | 11/1993 | Engel et al. | 29/888.044 |
| 5,553,378 | | 9/1996 | Parekh et al. | 29/888.044 |
| 5,642,654 | | 7/1997 | Parekh et al. | 92/260 |
| 5,950,063 | * | 9/1999 | Hens et al. | 419/5 |
| 5,972,269 | * | 10/1999 | Barros et al. | 264/221 |
| 5,980,820 | * | 11/1999 | Takeuchi | 419/37 |
| 6,080,358 | * | 6/2000 | Oba et al. | 419/5 |

* cited by examiner

*Primary Examiner*—Ngoclan Mai
(74) *Attorney, Agent, or Firm*—Zarley, McKee, Thomte, Voorhees & Sease

(57) ABSTRACT

A method of manufacturing a hollow piston including: fixing a core insert formed of a non-metallic material in a desired location within a mold cavity, injecting a mixture of non-metallic binder material and metal particles into the cavity so as to surround at least a portion of the core insert and form a piston, and eradicating the core insert from the piston.

10 Claims, 4 Drawing Sheets

METHOD OF PRODUCING A HOLLOW PISTON FOR A HYDROSTATIC POWER UNIT

BACKGROUND OF THE INVENTION

The present invention relates to the field of hydrostatics, more particularly, hydraulic pistons used in the cylinder block of a hydrostatic power unit. The present invention relates to hollow or reduced oil volume pistons and methods of producing the same.

It is conventional to use solid steel pistons in the rotating cylinder block of a hydrostatic power unit. Solid steel pistons are durable, reliable, and inexpensive to make, but their weight tends to impose limitations on the speed of operation for the cylinder blocks in which they are used. They also develop more operational frictional forces.

Consequently, some manufacturers have constructed hollow pistons that weigh less than the solid steel pistons. One common and conventional method of making hollow pistons involves rough turning a hollow piston body and a separate piston cap from steel barstock. Then the body and cap are joined together by conventional welding techniques, such as inertia welding, to form a piston with a hollow interior. However, many fabrication steps with tight tolerances or process controls are required to make such welded hollow pistons, which makes them relatively costly to manufacture. Hollow pistons weigh less than solid pistons but don't necessarily reduce the compressed oil volume of the hydrostatic unit unless they are welded shut to enclose an internal void. Reduced compressible oil volume provides better control of swashplate moments and efficiency in swashplate controlled hydrostatic power units.

Therefore, a principal objective of this invention is the provision of an improved method for producing hollow pistons used in the cylinder block of a hydrostatic power unit.

Another objective of this invention is the provision of an easy and inexpensive method for producing hollow pistons.

Another objective of this invention is the provision of a method for producing hollow pistons by utilizing a unique combination of new and conventional metal injection molding techniques.

Another objective of this invention is the provision of a method for producing hollow pistons that involves the steps of securing a core insert of a non-metallic material in a mold, filling the mold with a mixture of non-metallic binding material and metal particles, then eradicating the non-metallic binding material to leave a void in the cast piston.

Another objective of this invention is the provision of a method for producing hollow pistons that reduces the number and difficulty of the subsequent machining operations required to finish the piston.

These and other objectives will be apparent to one skilled in the art from the drawings, as well as from the following description and claims.

SUMMARY OF THE INVENTION

The present invention relates to methods for producing a hollowed piston for use in the cylinder block of the hydrostatic power unit.

The method includes the steps of fixing a core insert formed of a non-metallic material in a desired location within the cavity of a mold, injecting a mixture of a non-metallic binder material and metal particles into the cavity so as to surround at least a portion of the core insert and form a piston, and eradicating the core insert from the piston. The core insert can be eradicated by various methods, including raising its temperature to melt it or chemically disintegrating it. The cast piston can be further heated to debind the non-metallic binder material from the metal particles and metallurgically bond the metal particles to each other. The core insert can be formed by injection molding a thermoplastic material and the filling step can be carried out by conventional metal injection molding techniques.

Of course, once the core insert has been eradicated, it could also be replaced in whole or part with a lighter-than-oil filler material suitable to withstand the typical operating conditions of the hydrostatic unit. This would reduce the volume of compressible oil in the piston without significantly increasing the weight of the piston. In low pressure hydrostatic units or applications, there is little risk of the filler material being forced out by the oil pressure experienced by the piston.

DETAILED DESCRIPTION OF THE PREFERRED EMBODIMENTS

Figure 1:
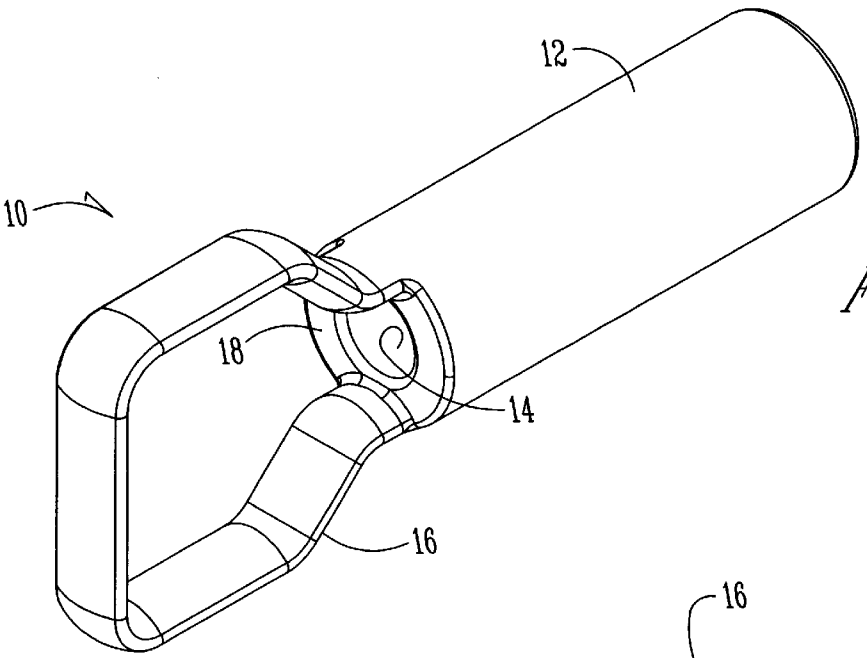
FIG. 1 is a perspective view of one embodiment of the core insert utilized in the method of this invention.
Figure 2:
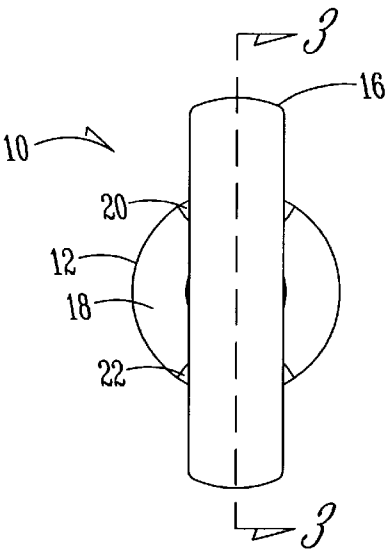
FIG. 2 is a top plan view of the core insert of FIG. 1.
Figure 3:
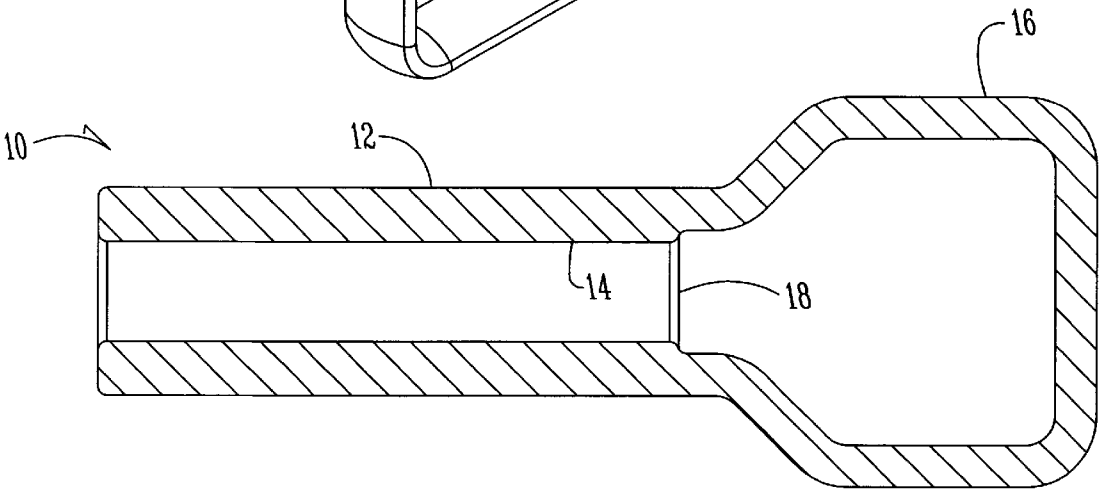
FIG. 3 is a longitudinal sectional view of the core insert taken along line 3—3 in FIG. 2.
Figure 4:
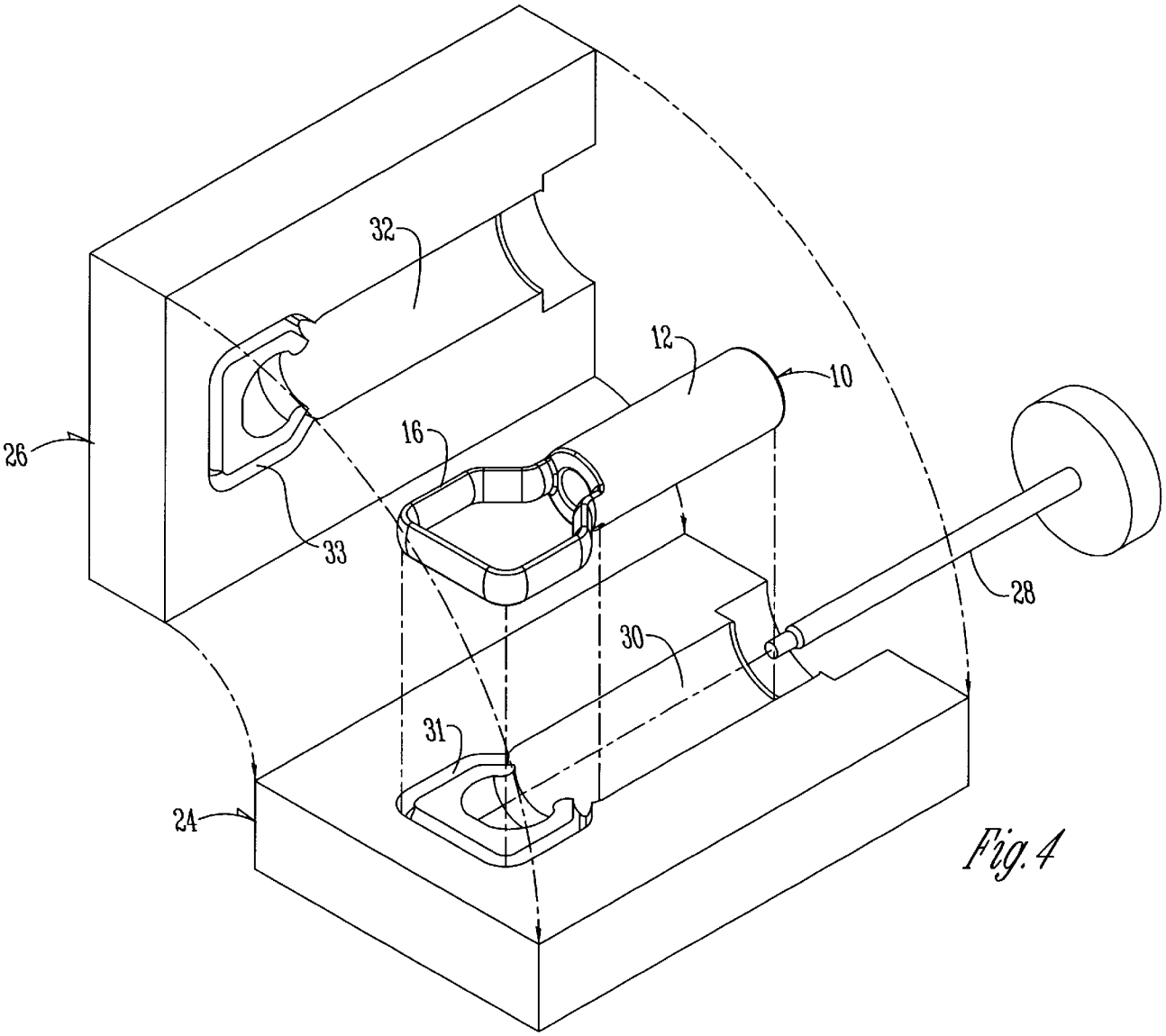
FIG. 4 is an exploded view of the core insert and a metal injection molding setup for forming a piston around the core insert.
Figure 5:
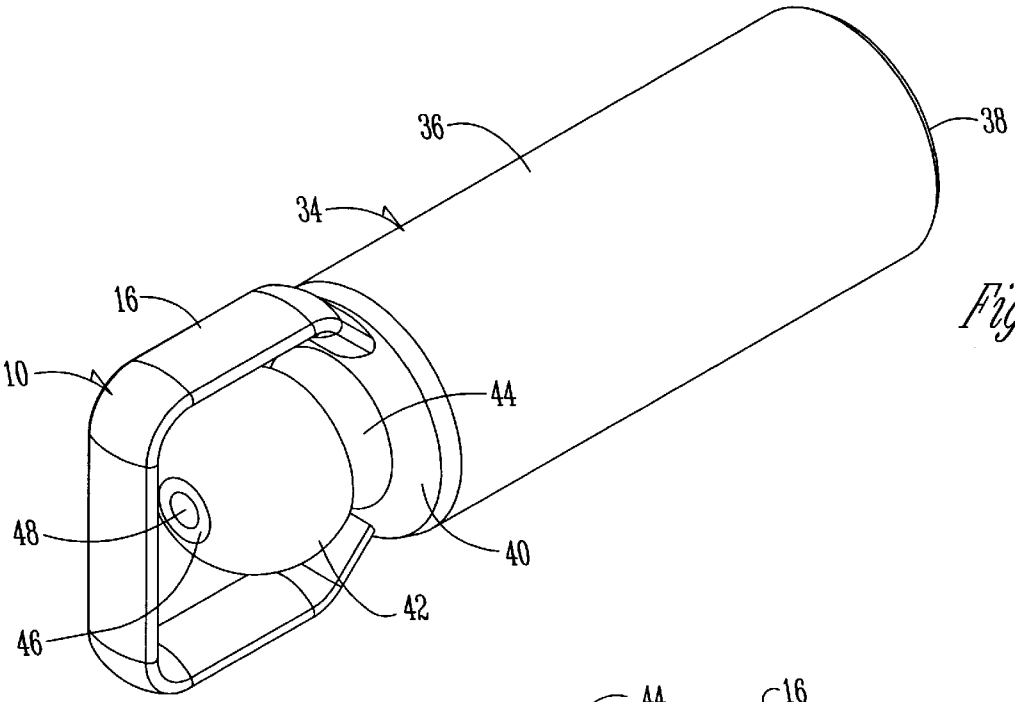
FIG. 5 is a perspective view of the piston formed around the core insert.
Figure 6:
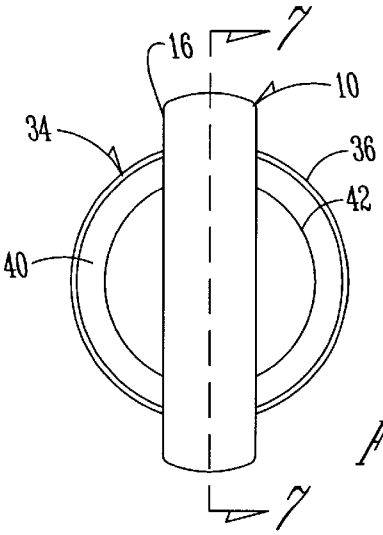
FIG. 6 a top plan view of the piston and core insert of FIG. 5.
Figure 7:
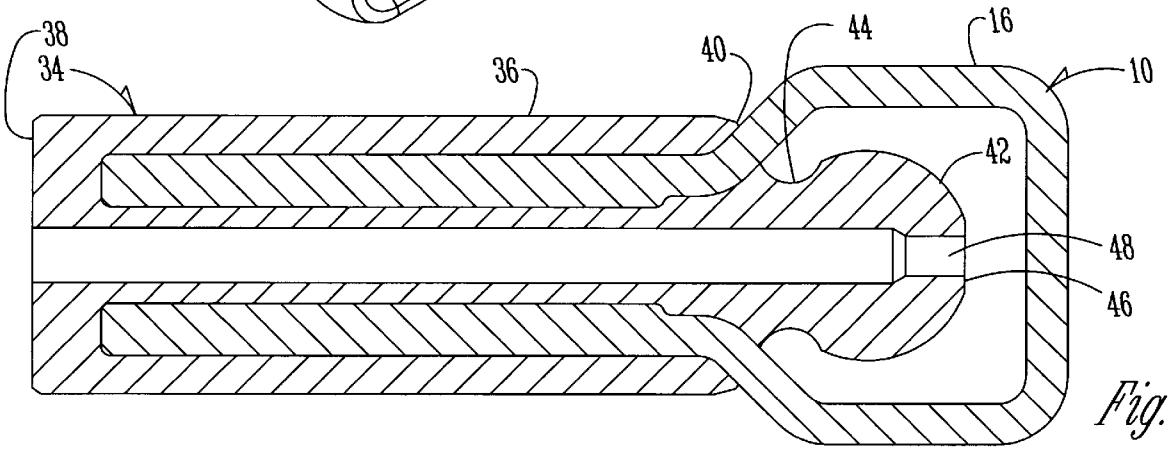
FIG. 7 is a longitudinal sectional view of the piston and core insert taken along line 7—7 in FIG. 6.
Figure 8:
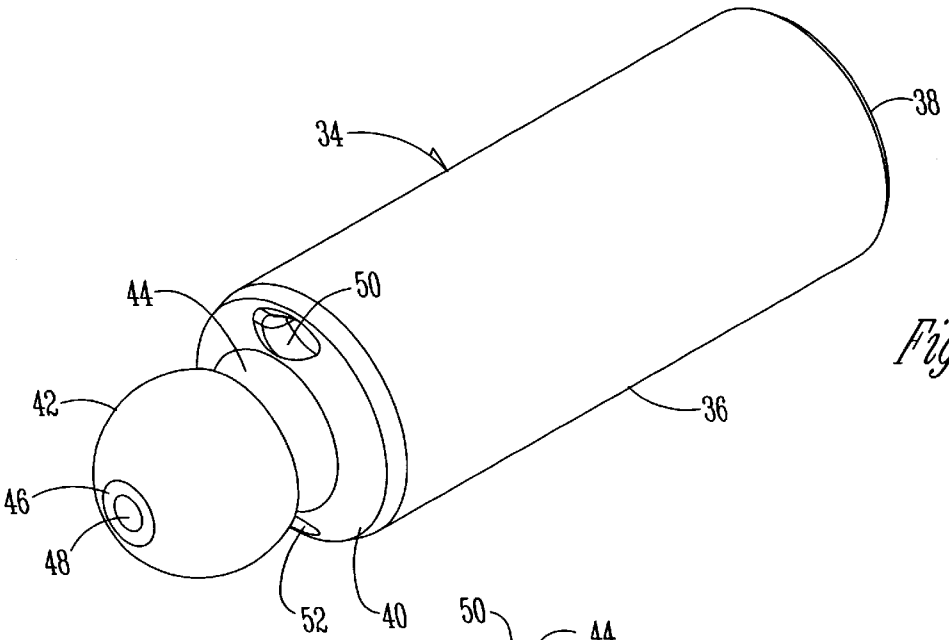
FIG. 8 is a perspective view of the piston after the core insert has been eradicated therefrom.
Figure 9:
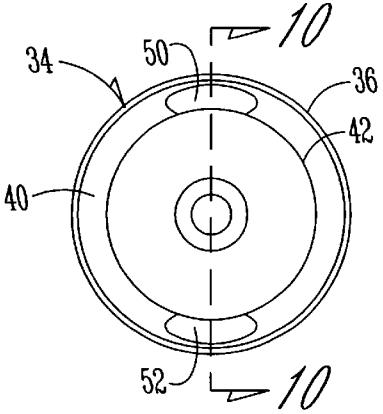
FIG. 9 is a top plan view of the piston of FIG. 8.
Figure 10:
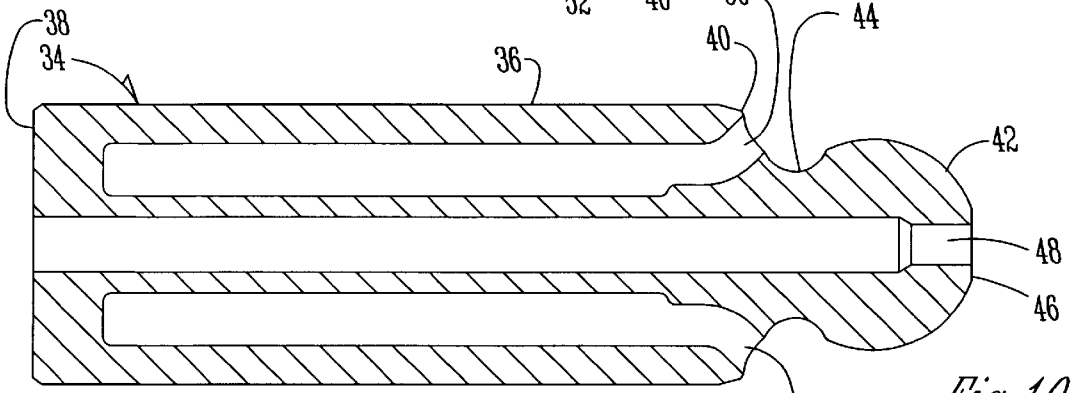
FIG. 10 is a longitudinal sectional view of the piston taken along line 10—10 in FIG. 9.

In general, FIGS. 1–10 depict the formation of a hollowed piston according to this invention. FIGS. 1–3 show the eradicatible core insert 10. FIG. 4 illustrates one possible metal injection molding setup for molding a mixture of binder material and metal particles around the core insert 10 to form a piston. The resulting piston and core insert combination is shown in FIGS. 5–7, while FIG. 8–10 show the hollowed piston that results once the core insert 10 has been eradicated.

Referring to FIGS. 1–3, a substantially rigid core insert 10 is formed using conventional injection molding techniques. The core insert 10 is formed of a non-metallic material, preferably a thermoplastic material, such as the binding material used in conventional metal injection molding processes. Such materials are preferred because they contain no metal particles and melt at temperatures well below those required to metallurgically bond metal particles. Such thermoplastic binding materials are commercially available from General Polymers, of Columbus, Ohio, a division of Ashland Chemical Company.

The core insert 10 has an elongated body 12 with an optional hole 14 extending therethrough. An anchoring tab or ring 16 extends from the upper surface 18 of the body and is connected to the upper surface 18 at neck portions 20 and 22 respectively. As one skilled in the art can appreciate, the tab or ring 16 could be attached to the body 12 in other locations without significantly detracting from the invention.

As illustrated in FIG. 4, the resulting core insert 10 is then placed in a metal injection mold having first and second complimentary mold portions 24, 26. An optional retractable or removable core pin portion 28 can be provided in the mold if a through hole is desired in the piston. If utilized, the pin portion 28 is preferably concentric to the hole 14 of the core insert 10. (See FIG. 7) The first mold portion 24 has a cavity 30 formed therein. Part of the cavity 30 is used for forming the piston itself. Another portion of the cavity 30 includes a groove 31 that accommodates half of the anchoring ring 16 as shown. The second mold portion 26 includes a cavity 32 for forming the piston itself and a groove 33 connected thereto as shown to accommodate the other half of the anchoring ring 16. Thus, due to the grooves 31, 32, the core insert 10 is held in a fixed position within the mold 24, 26 during the filling step. Conventional gates for incoming material and venting are provided in the mold according to well-known practices in the metal injection molding (MIM) art. Conventionally, the MIM material is a mixture of metal particles and a non-metallic binder material. One skilled in the metallurgical arts can specify or select the mixture from a variety of commercially available formulations to achieve the desired properties for the resulting piston.

FIGS. 5–7 show the piston that results from filling or injecting the joined cavities 30, 32 of the mold 24, 26 with the mixture. The molded piston 34 is sometimes referred to in the metal injection molding art as a "green part." The geometry of the mold causes the green part 34 to have an outer cylindrical surface 36, an end 38, a shoulder 40, a partial spherical ball 42, and an undercut or radiused groove 44 between the shoulder 40 and the ball 42. The ball 42 has a substantially flat end surface 46. A fluid passageway or through hole 48 extends longitudinally through the center of the cast piston 34. The anchoring ring 16 of the core insert 10 protrudes from the shoulder 40 of the cast piston 34 as shown, and at least a portion of the core insert 10 is surrounded by the mixture. Of course, the outside geometry of the part can be changed to optimize the metal injection molding process.

Next, the molded piston 34 or green part is removed from the mold and processed to debind the non-metallic binding material and eradicate (disintegrate, obliterate, or melt out) the core insert 10. This can be done in a variety of ways. One method is to heat or raise the temperature of the piston 34 to a temperature sufficient to cause the core insert 10 to melt. Preferably, the eradication temperature for the core insert 10 is less than the temperature required to metallurgically bond together the metal particles of the piston 34. Another method of eradicating the core insert 10 is to disintegrate it in a chemical or physiochemical reaction with an appropriate catalyst such as an acid, ultraviolet light, irradiation or other such means as would be understood by one skilled in the art.

FIGS. 8–10 show the molded piston 34 after the core insert 10 has been eradicated. Now the piston 34 has openings or apertures 50, 52 where the core insert 10 formerly protruded from the shoulder 40 of the body 36. These openings 50, 52 are in fluid communication with the cavity or void 54 left in the piston 34 by the eradication of the core insert 10. The hollowed piston is subsequently heated to a temperature sufficient to metallurgically bond together the metallic particles as is conventional in the MIM art.

At this point, the part has sufficient strength to be finished with typical turning and grinding processes. However, these final machine operations are less costly because the part is very near the required net shape and strength required of the finished part. A hollowed piston has been formed in a reliable, efficient and economical manner.

Of course, once the core insert has been eradicated, it could also be replaced in whole or part with a lighter-than-oil filler material suitable to withstand the typcial operating conditions of the hydrostatic unit. This would reduce the volume of compressible oil in the piston without significantly increasing the weight of the piston. In low pressure hydrostatic units or applications, there is little risk of the filler material being forced out by the oil pressure experienced by the piston.

Therefore, it can be seen that the present invention at least achieves its stated objectives.

In the drawings and specification, there has been set forth a preferred embodiment invention, and although specific terms are employed, these are used in a generic and descriptive sense only and not for purposes of limitation. Changes in the form and proportion of parts, as well as in the substitution of equivalents and rearrangement of steps, are contemplated as circumstances may suggest or render expedient without departing from the scope of the invention as defined in the claims that follow.

What is claimed is:

1. A method of producing a hollow piston comprising:

forming a core insert of non-metallic material;

securing the core insert within a cavity of a die or mold, the cavity being larger than the core insert;

filling the cavity with a mixture of non-metallic binder material and metal particles so as to surround at least a portion of the core insert to form a piston;

eradicating the core insert from the piston so as to leave a void in the piston; and elevating the temperature of the piston to a temperature sufficient to debind the non-metallic binder material from the metal particles and metallurgically bond the metal particles to each other.

2. The method of claim 1 comprising removing the piston from the mold before eradicating the core insert therefrom.

3. The method of claim 1 wherein the core insert has an eradication temperature less than the temperature required to metallurgically bond the metal particles.

4. The method of claim 1 wherein the eradicating step is carried out by heating the core insert to a temperature sufficient to melt the core insert.

5. The method of claim 1 wherein the eradicating step is carried out by disintegrating the core insert in a chemical reaction.

6. The method of claim 1 wherein the core insert is formed by injection molding a thermoplastic material.

7. The method of claim 1 wherein the filling step is carried out by injection molding the mixture into the mold.

8. The method of claim 1 comprising holding the core insert in a fixed position within the mold during the filling step.

9. The method of claim 1 wherein the core insert has a central bore formed therein and a core pin is inserted into the bore and concentrically spaced inwardly therefrom prior to filling the cavity.

10. A method of manufacturing a hollow piston comprising:

fixing a core insert formed of a non-metallic material in a desired location within a mold cavity;

injecting a mixture of non-metallic binder material and metal particles into the cavity so as to surround at least a portion of the core insert and form a piston; and eradicating the core insert from the piston.

* * * * *